US010473352B2

(12) United States Patent
Park et al.

(10) Patent No.: US 10,473,352 B2
(45) Date of Patent: Nov. 12, 2019

(54) AIR CONDITIONER AND CONTROL METHOD THEREOF

(71) Applicant: Samsung Electronics Co., Ltd., Suwon-si, Gyeonggi-do (KR)

(72) Inventors: Jee-ho Park, Yongin-si (KR); Eom-ji Jang, Anyang-si (KR); Kwon-jin Kim, Suwon-si (KR); Young-seok Lim, Suwon-si (KR); Euy-sung Chu, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 102 days.

(21) Appl. No.: 15/699,391

(22) Filed: Sep. 8, 2017

(65) Prior Publication Data

US 2018/0100666 A1 Apr. 12, 2018

(30) Foreign Application Priority Data

Oct. 6, 2016 (KR) ..... 10-2016-0128862

(51) Int. Cl.
*F24F 11/30* (2018.01)
*F24F 6/04* (2006.01)
(Continued)

(52) U.S. Cl.
CPC ..... *F24F 11/30* (2018.01); *F24F 6/04* (2013.01); *F24F 2006/006* (2013.01);
(Continued)

(58) Field of Classification Search
CPC ..... F24F 6/04; F24F 11/30; F24F 2006/006; F24F 2006/008; F24F 2006/046; F24F 2110/00; F24F 2110/20
See application file for complete search history.

(56) References Cited

U.S. PATENT DOCUMENTS 4,389,352 A * 6/1983 Bohanon, Sr. ..... F24F 6/04 261/106
4,615,844 A 10/1986 Dickison et al.
(Continued)

FOREIGN PATENT DOCUMENTS

CN 101153729 A 4/2008
CN 201890828 U 7/2011
(Continued)

OTHER PUBLICATIONS

Communication from a foreign patent office in a counterpart foreign application, European Patent Office, "Communication," Application No. EP 17192619.9, dated Apr. 4, 2018, 9 pages.
(Continued)

*Primary Examiner* — Marc E Norman

(57) ABSTRACT

An air conditioner includes a main body, a fan configured to cause air to flow through the main body, and a water reservoir detachably disposed on an upper portion of the main body. A humidifying fabric member is disposed inside the main body and configured to receive water from the water reservoir. A water collecting tank is configured to collect water that flows down from the humidifying fabric member. In addition, a pump is configured to pump the water in the water collecting tank to the water reservoir through a suction hole. A bottom of the water collecting tank is formed to be downwardly inclined toward one portion of the bottom and the suction hole of the pump is disposed adjacent to the one portion.

17 Claims, 13 Drawing Sheets

(51) Int. Cl.
*F24F 110/20* (2018.01)
*F24F 110/00* (2018.01)
*F24F 6/00* (2006.01)

(52) U.S. Cl.
CPC ... *F24F 2006/008* (2013.01); *F24F 2006/046* (2013.01); *F24F 2110/00* (2018.01); *F24F 2110/20* (2018.01)

(56) References Cited

U.S. PATENT DOCUMENTS

| | | | | |
|---|---|---|---|---|
| 5,490,957 | A | 2/1996 | Lasko et al. | |
| 8,007,575 | B2 | 8/2011 | Dobashi | |
| 2006/0208368 | A1* | 9/2006 | Hayden | B05B 17/085 261/36.1 |
| 2008/0072758 | A1 | 3/2008 | Dobashi | |
| 2015/0153052 | A1* | 6/2015 | Saito | F24F 11/0008 261/128 |
| 2015/0219346 | A1* | 8/2015 | Morikawa | F24F 3/14 261/136 |
| 2016/0348929 | A1* | 12/2016 | Lee | F24F 6/04 |

FOREIGN PATENT DOCUMENTS

| | | | |
|---|---|---|---|
| CN | 102705946 | A | 10/2012 |
| CN | 203715779 | U | 7/2014 |
| CN | 204043116 | U | 12/2014 |
| CN | 105229383 | A | 1/2016 |
| EP | 1798493 | A2 | 6/2007 |
| EP | 1953462 | A2 | 8/2008 |
| EP | 2436998 | A2 | 4/2012 |
| GB | 2326938 | A | 1/1999 |
| JP | 2004181279 | A | 7/2004 |
| KR | 10-0322809 | B1 | 2/2002 |
| KR | 2003-0065427 | A | 8/2003 |
| KR | 10-0541036 | B1 | 1/2006 |
| KR | 10-2009-0087560 | A | 8/2009 |
| KR | 10-1423831 | B1 | 7/2014 |
| KR | 10-2014-0115491 | A | 10/2014 |
| KR | 10-1612038 | B1 | 4/2016 |
| KR | 10-2016-0056775 | A | 5/2016 |
| WO | 2015/146050 | A1 | 10/2015 |
| WO | 2016076642 | A1 | 5/2016 |

OTHER PUBLICATIONS

European Search Report dated Sep. 13, 2018 in connection with European Patent Application No. 17 19 2619, 10 pages.
China National Intellectual Property Administration, "Notification of the First Office Action," Application No. CN201710805878.6, dated Aug. 22, 2019, 13 pages.

* cited by examiner

AIR CONDITIONER AND CONTROL METHOD THEREOF

CROSS-REFERENCE TO RELATED APPLICATION AND CLAIM OF PRIORITY

This application is related to and claims priority to Korean Patent Application No. 10-2016-0128862, filed Oct. 6, 2016, the contents of which are incorporated herein by reference.

TECHNICAL FIELD

The present disclosure relates to an air conditioner having a humidification function and a control method thereof.

BACKGROUND

Generally, a humidifier may keep indoor humidity at an appropriate level, so the humidifier can prevent various respiratory diseases and maintain a pleasant atmosphere even in a dry place.

Such a humidifier may operate in various humidifying methods. Among these humidifying methods, the evaporative humidifying method is the structure in which water is supplied to a water collecting tank of the humidifier, a humidifying fabric is wet by rotation of a water turbine disposed in the water collecting tank, and ambient air is forced to pass through the humidifying fabric by a fan, so that the air turns into humid air and the humid air is discharged to the outside of the humidifier.

Since the water collecting tank of the humidifier has water, the scale may be formed on the inner wall of the water collecting tank and an environment in which microbes can reproduce easily may be formed. There is a problem that odor is generated from the water in the water collecting tank due to this. As a result, the consumer often has to clean the water collecting tank of the humidifier.

SUMMARY

To address the above-discussed deficiencies, it is a primary object to overcome the above drawbacks and other problems associated with the conventional arrangement. An aspect of the present disclosure relates to an air conditioner that can sterilize water stored in a water reservoir, circulate water used for humidification so that water is not continuously accumulated in a water collecting tank, and minimize water remaining in the water collecting tank to prevent scale formation and propagation of microorganisms in the water collecting tank and a control method of the air conditioner.

According to an aspect of the present disclosure, an air conditioner may include a main body; a fan configured to cause air to flow through the main body; a water reservoir detachably disposed on an upper portion of the main body; a humidifying fabric member disposed inside the main body and configured to receive water from the water reservoir; a water collecting tank configured to collect water that flows down from the humidifying fabric member; and a pump configured to pump the water in the water collecting tank to the water reservoir through a suction hole, wherein a bottom of the water collecting tank is formed to be downwardly inclined toward one portion of the bottom and the suction hole of the pump is disposed adjacent to the one portion.

According to an aspect of the present disclosure, an air conditioner may include a main body; a humidifying fabric disposed inside the main body; a water collecting tank disposed downstream of the humidifying fabric; a pump configured to circulate water from the downstream of the humidifying fabric to upstream of the humidifying fabric; and a fan configured to circulate air from outside of the main body, and to cause the air to pass through the humidifying fabric moistened with water, wherein a suction hole of the pump corresponds to a lowest portion of a bottom of the water collecting tank.

According to an aspect of the present disclosure, a control method of an air conditioner may include identifying whether a water reservoir and a humidifying fabric member are mounted on a main body of the air conditioner; informing that at least one of the water reservoir and the humidifying fabric member is absent when the at least one of the water reservoir and the humidifying fabric member is not mounted; sterilizing water in the water reservoir when both of the water reservoir and the humidifying fabric member are mounted; performing a humidifying operation of supplying the sterilized water to the humidifying fabric member, circulating air to pass through the humidifying fabric member containing moisture, and discharging the air to an outside of the main body of the air conditioner; terminating the humidifying operation when a predetermined time elapses; and pumping the water collected in a water collecting tank through the humidifying fabric member to the water reservoir after the humidifying operation is terminated.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
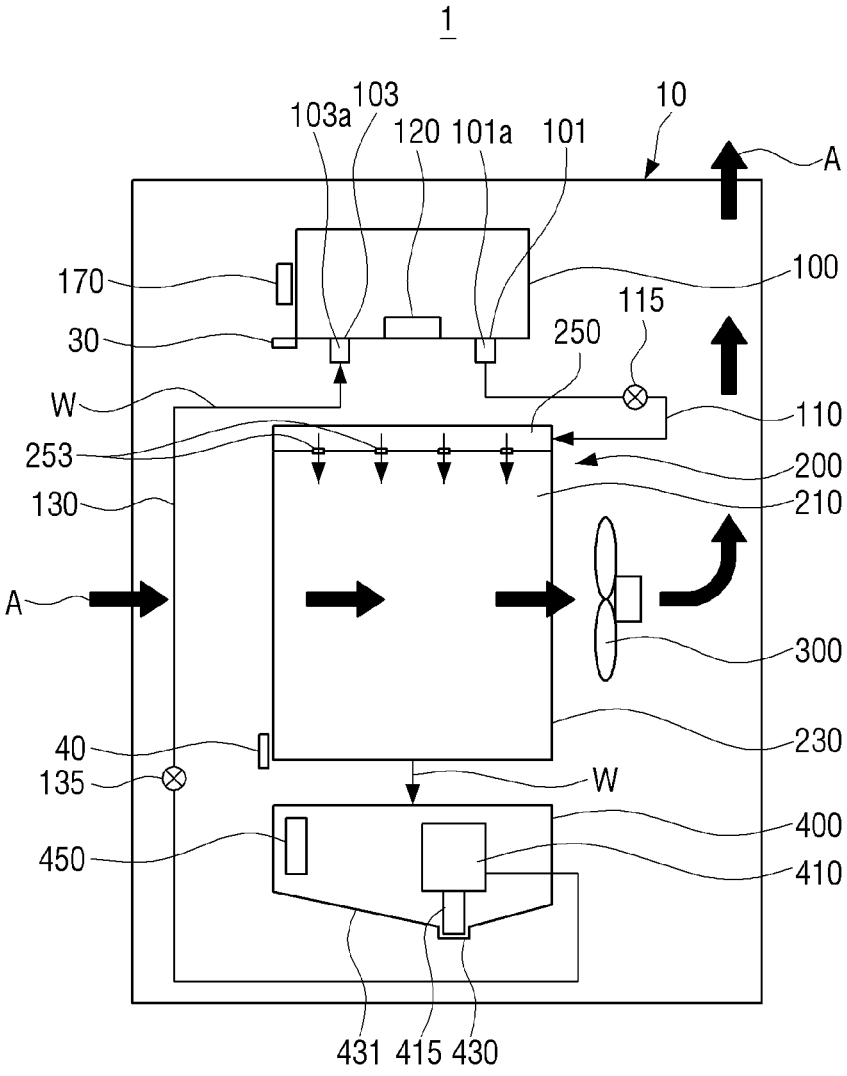
FIG. 1 is a view schematically illustrating an air conditioner according to an embodiment of the present disclosure.

FIGS. 1 through 10, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Hereinafter, certain exemplary embodiments of the present disclosure will be described in detail with reference to the accompanying drawings.

Exemplary embodiments described below will be explained on the basis of the embodiments best suited to understand technical features of the present disclosure, and the technical features of the present disclosure are not limited by the exemplary embodiments described. The present disclosure may be implemented as the exemplary embodiments described below.

Therefore, the present embodiment includes all modifications, equivalents, and substitutions without departing from the technical scope of the present disclosure through the exemplary embodiments described below. In regard to reference numerals indicated in the accompanying drawings in order to facilitate understanding of the exemplary embodiments to be described below, related components among components that perform the same operation in each embodiment are indicated by the same or extension numeral.

The matters defined herein, such as a detailed construction and elements thereof, are provided to assist in a comprehensive understanding of this description. Thus, it is apparent that exemplary embodiments may be carried out without those defined matters. Also, well-known functions or constructions are omitted to provide a clear and concise description of exemplary embodiments. Further, dimensions of various elements in the accompanying drawings may be arbitrarily increased or decreased for assisting in a comprehensive understanding.

The terms "first", "second", etc. may be used to describe diverse components, but the components are not limited by the terms. The terms are only used to distinguish one component from the others.

The terms used in the present application are only used to describe the exemplary embodiments, but are not intended to limit the scope of the disclosure. The singular expression also includes the plural meaning as long as it does not differently mean in the context. In the present application, the terms "include" and "consist of" designate the presence of features, numbers, steps, operations, components, elements, or a combination thereof that are written in the specification, but do not exclude the presence or possibility of addition of one or more other features, numbers, steps, operations, components, elements, or a combination thereof.

Referring to FIG. 1, the configuration of an air conditioner according to an embodiment of the present disclosure will be described along a circulation path of water.

FIG. 1 is a view schematically illustrating an air conditioner according to an embodiment of the present disclosure. In FIG. 1, thin arrow marks W indicate a direction of movement of water, and thick arrow marks A indicate a direction of movement of air.

Referring to FIG. 1, an air conditioner 1 according to an embodiment of the present disclosure may include a main body 10, a fan 300 that forcedly flows air to pass through the main body 10, a water reservoir 100 detachably coupled to an upper portion of the main body 10, a humidifying fabric member 200 that is disposed inside the main body 10 and receives water from the water reservoir 100, a water collecting tank 400 that collects the water flowing down from the humidifying fabric member 200, and a pump 410 that pumps the water in the water collecting tank 400 to the water reservoir 100.

After a predetermined amount of water is stored in the water reservoir 100, the water reservoir 100 is mounted on the upper portion of the main body 10. When the air conditioner 1 operates in a humidification mode after the water reservoir 100 storing the water is mounted, the process of circulating the water is as follows.

The water stored in the water reservoir 100 is sterilized by a sterilizing kit 120. When a solenoid valve 115 is opened, the water stored in the water reservoir 100 is supplied to the upper end of the humidifying fabric member 200 through a water collecting pipe 110. The water supplied to the humidifying fabric member 200 flows down along the humidifying fabric member 200 by gravity and wets a humidifying fabric. The fan 300 disposed adjacent to the humidifying fabric member 200 is driven to circulate air from outside the main body 10. The air circulated into the main body 10 contains moisture while passing through the humidifying fabric member 200, and air containing moisture is discharged to the outside of the main body 10 by the fan 300. As a result, the humidity of the indoor air is increased by the humid air including moisture, so that the dry indoor environment may be changed into a pleasant environment.

On the other hand, the water flowing down from the humidifying fabric member 200 is collected in the water collecting tank 400. The water collected in the water collecting tank 400 is pumped by the pump 410 and is returned to the water reservoir 100 through a circulation pipe 130 again. In this case, the bottom 431 of the water collecting tank 400 is formed to be inclined downward toward one point. In this case, a collecting groove 430 is formed at the one point as described above, and a suction hole of the pump 410 is positioned adjacent to the collecting groove 430. This structure may prevent water from remaining in the water collecting tank 400, thereby preventing contamination of the water in the water collecting tank 400. In this case, since the water collected in the water collecting tank 400 is sterilized by the sterilizing kit 120, even when water is collected in the water collecting tank 400, there is almost no possibility that the water is decayed by microorganisms.

As described above, the air conditioner 1 according to an embodiment of the present disclosure may not only sterilize water supplied to the humidifying fabric member 200, but also circulate water to prevent water from being contaminated. In addition, the water collecting tank 400 may minimize the amount of residual water, thereby solving the problems caused by the increase of water.

Figure 2:
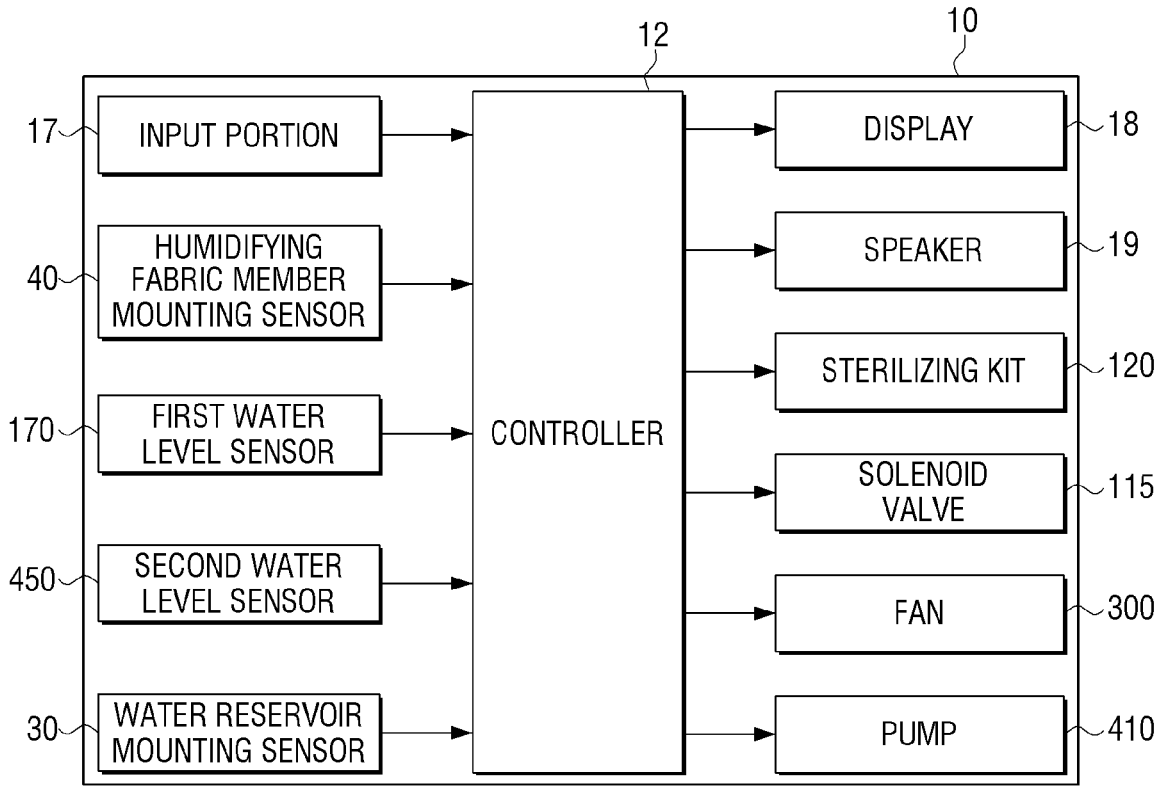
FIG. 2 is a block diagram schematically illustrating a control system of an air conditioner according to an embodiment of the present disclosure.

FIG. 2 is a block diagram schematically illustrating a control system of an air conditioner according to an embodiment of the present disclosure.

Referring to FIG. 2, input terminals of a controller 12 of the air conditioner 1 may be electrically connected to an input portion 17 that receives a control command from a user, a humidifying fabric member mounting sensor 40 that senses mounting of the humidifying fabric member 200, a first water level sensor 170 that senses the water level of the water reservoir 100, a second water level sensor 450 that senses the water level of the water collecting tank 400, and a water reservoir mounting sensor 30 that senses whether the water reservoir 100 is mounted.

Also, output terminals of the controller 12 may be electrically connected to the sterilizing kit 120 that sterilizes water stored in the water reservoir 100 through electrolysis, the solenoid valve 115 that controls water supply from the water reservoir 100 to the humidifying fabric member 200, the fan 300 that forcibly circulates air into the main body 10, the pump 410 that pumps water in the water collecting tank 400, a display 18 that displays various control menus and information for operating the air conditioner 1, and a speaker 19 that outputs sound.

Hereinafter, the configurations of the air conditioner 1 according to an embodiment of the present disclosure will be described in detail with reference to the drawings.

Figure 3:
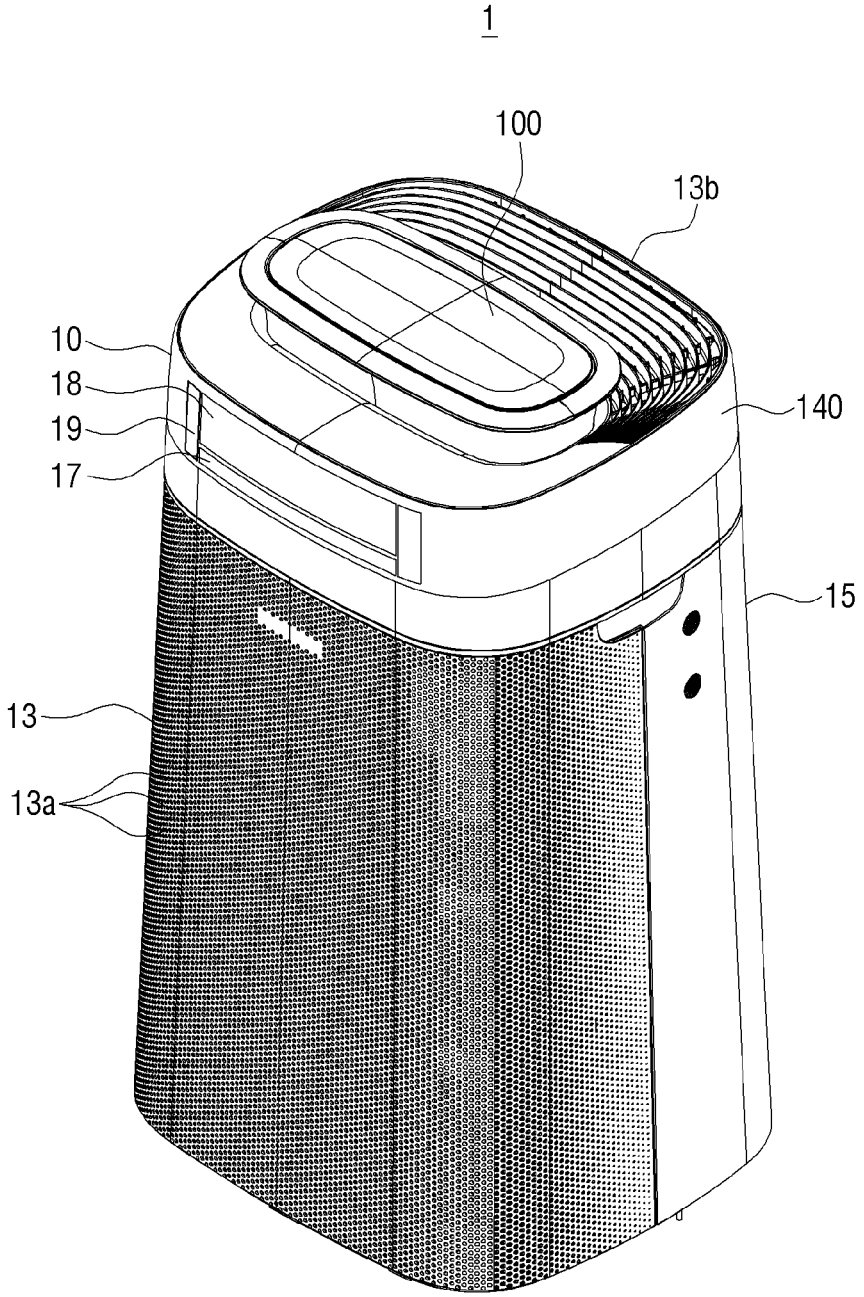
FIG. 3 is a perspective view illustrating an air conditioner according to an embodiment of the present disclosure.
Figure 4:
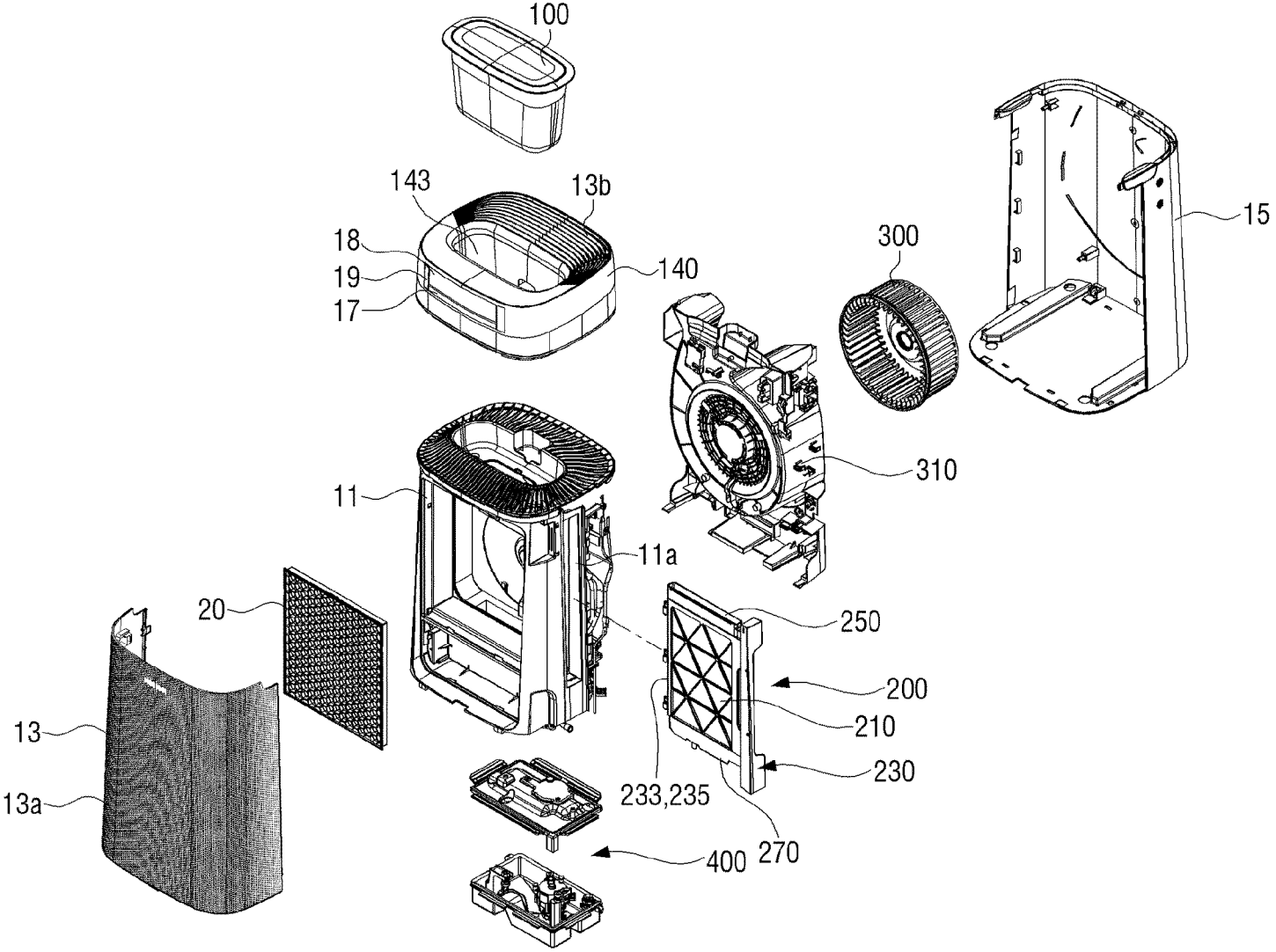
FIG. 4 is an exploded perspective view illustrating an air conditioner according to an embodiment of the present disclosure.

FIGS. 3 and 4 are views illustrating an assembled state and a disassembled state of an air conditioner according to an embodiment of the present disclosure, respectively.

Referring to FIGS. 3 and 4, the air conditioner 1 may include a main body 10 forming an outer appearance of the air conditioner 1, a water reservoir 100 coupled to the upper portion of the main body 10, a humidifying fabric member 200 that receives water from the water reservoir 100 and vaporize the water, a fan 300 that is disposed inside the main body 10 and forcedly flows air, and a water collecting tank 400 that collects water passing through the humidifying fabric member 200.

The main body 10 may include a housing 11, a front cover 13 coupled to the front of the housing 11, a rear cover 15 coupled to the rear of the housing 11, and a water reservoir receiving portion 140 coupled to the upper portion of the housing 11.

The front cover 13 is provided with an air inflow portion 13*a* through which dry indoor air flows into the main body 10. The top surface of the water reservoir receiving portion 140 is provided with an air discharge portion 13*b* through which air containing moisture while passing through the humidifying fabric member 200 of the main body 10 is discharged to the indoor.

This forced airflow is made by the fan 300. For example, the fan 300 may be a sirocco fan having a low noise. The air passage may be formed from the air inflow portion 13*a* to the air discharge portion 13*b* through the humidifying fabric member 200 by a suction force generated by the driving of the fan 300.

The display 18 for displaying various kinds of information of the air conditioner 1, the speaker 19 for transmitting information or an alarm to the user by sound, and the input portion 17 for receiving a user's input for controlling various functions of the air conditioner 1 may be disposed in the water reservoir receiving portion 140, respectively.

A filter member 20 may include a dust filter, a deodorization filter, and the like. The filter member 20 may be mounted or detached in the vertical direction inside the main body 10 after the water reservoir 100 and the water reservoir receiving portion 140 disposed in the upper portion of the main body 10 are separated.

The water reservoir 100 stores water required for humidification and supplies water to the humidifying fabric member 200 in an appropriate amount. The water reservoir 100 may be detachably mounted to the water reservoir receiving portion 140.

Figure 5A:
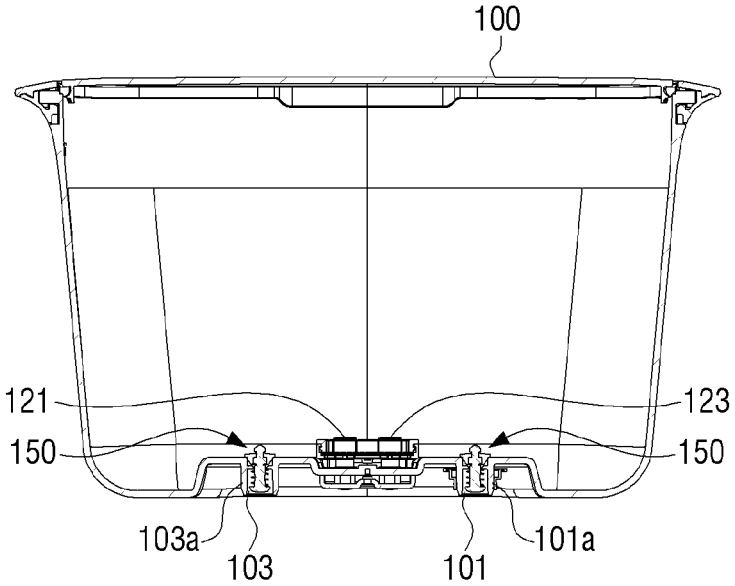
FIG. 5A is a cross-sectional view illustrating a state in which a water reservoir is separated from a water reservoir mounting portion formed in a main body of an air conditioner.
Figure 5A:
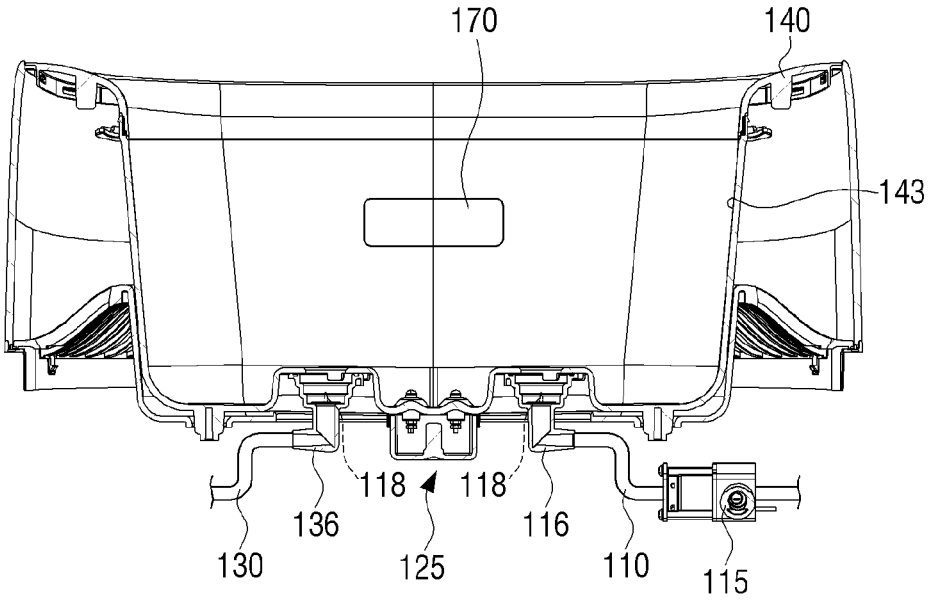
Figure 5B:
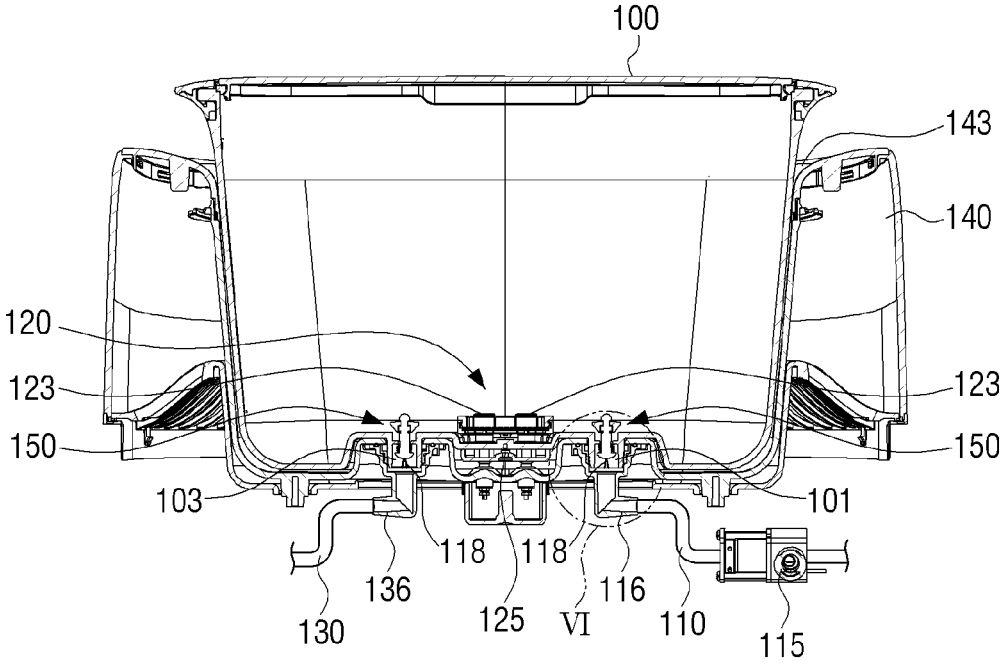
FIG. 5B is a cross-sectional view illustrating a state in which a water reservoir is coupled to a water reservoir mounting portion formed in a main body of an air conditioner.

FIGS. 5A and 5B are cross-sectional views illustrating a state in which a water reservoir is separated from a water reservoir mounting portion formed in a main body of an air conditioner and a state in which the water reservoir is coupled to the water reservoir receiving portion, respectively.

Referring to FIG. 5A, the water reservoir 100 is provided with a drain hole 101 to supply water to the humidifying fabric member 200 and an inlet hole 103 to receive water pumped from the water collecting tank 400 in the bottom of the water reservoir 100.

The drain hole 101 is in fluid communication with the humidifying fabric member 200 through the water collecting pipe 110. One end of the water collecting pipe 110 is connected to the drain hole 101 and the other end is connected to a water distributor 250 of the humidifying fabric member 200. The water collecting pipe 110 is provided with the solenoid valve 115 to control water supply to the humidifying fabric member 200. The solenoid valve 115 is controlled by the controller 12 so that when the air conditioner 1 is operated in the humidification mode, the solenoid valve 115 is opened to allow water to be supplied to the humidifying fabric member 200, and when the water collecting tank 400 becomes full water level or when various errors are detected, the solenoid valve 115 is closed to block the supply of water to the humidifying fabric member 200.

The inlet hole 103 is in fluid communication with the pump 410 through the circulation pipe 130. One end of the circulation pipe 130 is connected to the inlet hole 103 and the other end is connected to the pump 410. A check valve 135 is provided in the circulation pipe 130 so that water flowing into the water reservoir 100 does not flow back to the pump 410 due to gravity.

The water reservoir 100 may include the sterilizing kit 120 for removing microorganisms contained in water.

The sterilizing kit 120 electrolyzes the water stored in the water reservoir 100 during the humidification mode and the sterilization mode. Here, the water is tap water and contains ions to enable electrolysis. The sterilizing kit 120 may include a first electrode 121 and a second electrode 123. The first electrode 121 and the second electrode 123 are connected to a power supply portion 125 to receive a voltage from the power supply portion 125. In other words, when a voltage is applied to the first electrode 121 and the second electrode 123, a current flows through the first electrode 121 and the second electrode 123 due to the applied voltage. At this time, the first electrode 121 and the second electrode 123 have different polarities.

When electrolysis is performed using chloride ion $Cl^-$ or the like existing in tap water, chlorine $Cl_2$ is generated in the electrode having positive polarity, and hydrogen is generated in the electrode having negative polarity. At this time, the generated chlorine is dissolved in water to generate hydrogen chloride (HCl) and hypochlorous acid (HClO) which is a sterilizing effective ingredient. Accordingly, the water in the water reservoir 100 contains the hypochlorous acid component, and is supplied to the humidifying fabric member 200 in the humidification mode or the sterilization mode.

The water containing the hypochlorous acid component may be sprayed in a pure aseptic state as the hypochlorous acid component is filtered by a filter (not illustrated) of the humidifying fabric member 200. The filter may be disposed on a support frame 210 together with a humidifying fabric 210.

Since the water stored in the water reservoir 100 is sterilized by the sterilizing kit 120 as described above, the water reservoir 100, the water collecting pipe 110, the humidifying fabric member 200, the water collecting tank 400, the pump 410 and the circulation pipe 130 on the path where the water moves may be effectively prevented from being scaled and contaminated by bacteria.

On the other hand, the water reservoir 100 may be detachably disposed on a mounting groove 143 of the water reservoir receiving portion 140 formed on the upper part of the air conditioner 1. Since the water reservoir 100 is positioned at the uppermost portion of the air conditioner 1, the user can easily access the water reservoir 100 unlike the conventional air conditioner where the water reservoir is positioned at the side or the lower part of the main body. In addition, when a portion or the whole of the water reservoir 100 is formed of a transparent material, the amount of water stored in the water reservoir 100 may be visually checked.

The drain hole 101 and the inlet hole 103 are formed at the bottom of the water reservoir 100. The drain hole 101 and the inlet hole 103 are provided with an opening and closing valve 150 for opening and closing the drain hole 101 and the inlet hole 103, respectively.

The opening and closing valve 150 opens the drain hole 101 and the inlet hole 103 when the water reservoir 100 is mounted on the water reservoir receiving portion 140. The opening and closing valve 150 closes the drain hole 101 and the inlet hole 103 when the water reservoir 100 is detached from the water reservoir receiving portion 140.

Figure 6A:
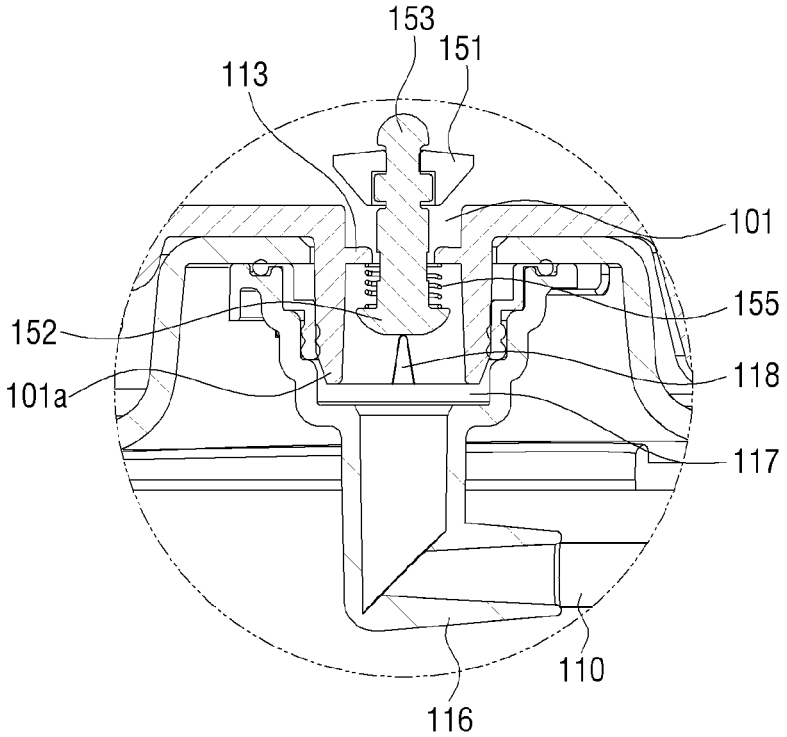
FIG. 6A is an enlarged view illustrating a portion VI shown in FIG. 5B.
Figure 6B:
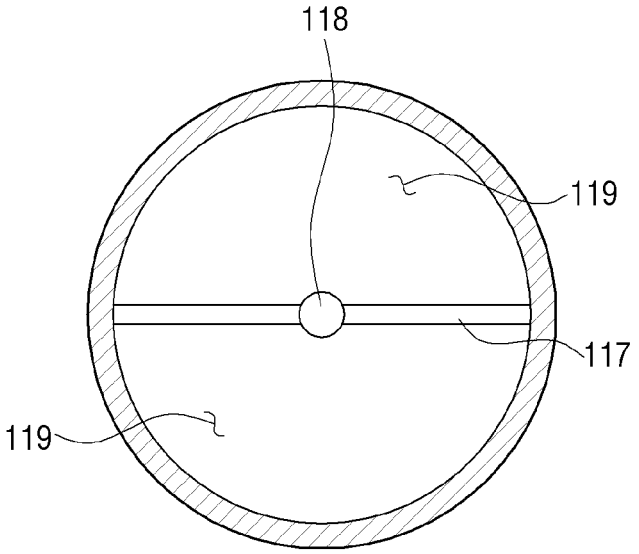
FIG. 6B is a top cross-sectional view illustrating a discharge connector of FIG. 6A.

FIG. 6A is an enlarged view illustrating a portion VI shown in FIG. 5B, that is, the opening and closing valve 150 disposed in the drain hole 101, and FIG. 6B is a top cross-sectional view illustrating a discharge connector of FIG. 6A.

Referring to FIG. 6A, the opening and closing valve 150 may include a packing member 151, a rod member 153, and an elastic member 155.

The packing member 151 is coupled to the upper portion of the rod member 153 and opens and closes the drain hole 101. The packing member 151 may be formed of a rubber material and have a high water-tightness when the drain hole 101 is closed.

The rod member 153 moves up and down a predetermined distance along a drain port 101*a* inside the drain port 101*a*. The lower end of the rod member 153 is provided with a hooking protrusion 152 for fixing the bottom end of the elastic member 155.

The elastic member 155 elastically supports the rod member 153 in the downward direction so that the packing member 151 closes the drain hole 101 in a state where no external force is applied to the rod member 153 (i.e., a state where the water reservoir 100 is separated from the mounting groove 143). In this case, one end of the elastic member 155 is supported by the hooking protrusion 152 of the rod member 153, and the other end thereof is supported by a blocking protrusion 113.

The opening and closing valve 150 disposed in the inlet hole 103 has the same structure as that of the opening and closing valve 150 disposed in the drain hole 101 as described above, so a detailed description thereof is omitted.

On the other hand, when the water reservoir 100 is mounted on the mounting groove 143 of the water reservoir receiving portion 140 as illustrated in FIG. 5B, the drain port 101*a* is inserted into a discharge connector 116 and the opening and closing valve 150 disposed in the drain hole 101 opens the drain hole 101 as illustrated in FIG. 6A. In detail, while the water reservoir 100 moves in the direction of mounting the water reservoir 100 to the mounting groove 143, the rod member 153 of the opening and closing valve 150 is interfered by a lead 118 provided inside the discharge connector 116, thereby being moved in a direction opposite to the mounting direction of the water reservoir 100. Thus, the packing member 151 moves together with the rod member 153 to open the drain hole 101.

Similarly, the opening and closing valve 150 disposed in the inlet hole 103 opens the inlet hole 103 as the water reservoir 100 is mounted.

Referring to FIG. 6B, the lead 118 is formed in a support member 117 provided to cross the inside of the discharge connector 116. The support member 117 has a narrow width so that the water discharged from the drain hole 101 can pass through the discharge connector 116.

The water reservoir receiving portion 140 is provided with a first water level sensor 170 to measure the water level of the water reservoir 100 on the side wall of the mounting groove 143. The first water level sensor 170 is in close contact with the outer surface of the water reservoir 100 when the water reservoir 100 is mounted in the mounting groove 143. The first water level sensor 170 may be a capacitive sensor that senses the water level of the water reservoir 100 by a capacitive method without directly contacting the water in the water reservoir 100.

In addition, a water reservoir mounting sensor 30 for detecting whether the water reservoir 100 is mounted may be disposed in the bottom of the water reservoir receiving portion 140. The water reservoir mounting sensor 30 may be implemented as a micro switch. When the water reservoir 100 is mounted on the mounting groove 143, the water reservoir mounting sensor 30 is pushed by the bottom of the water reservoir 100 and sends a water reservoir mounting signal to the controller 12. The controller 12 controls the operation of the solenoid valve 115, the fan 300, and the pump 410 after receiving the water reservoir mounting signal.

Figure 7:
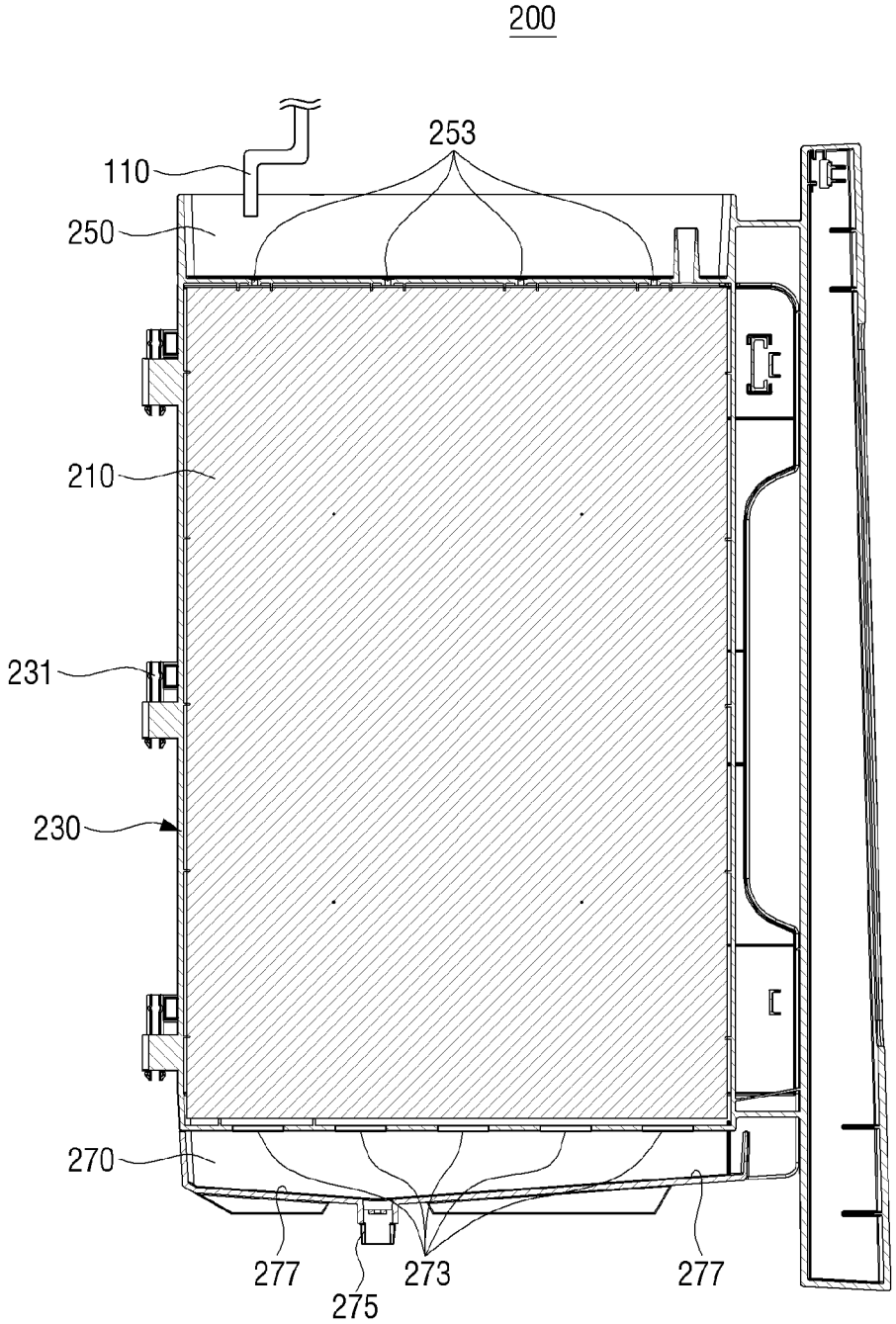
FIG. 7 is a cross-sectional view illustrating a humidifying fabric member.

The humidifying fabric member 200 may be disposed inside the housing 11 through a slot 11*a* (see FIG. 4) formed at one side surface of the housing 11. Whether or not the humidifying fabric member 200 is mounted may be detected by the humidifying fabric member mounting sensor 40 disposed in the housing 11. The humidifying fabric member mounting sensor 40 sends a humidifying fabric member mounting signal to the controller 12. The controller 12 may control the operation of the solenoid valve 115, the fan 300, and the pump 410 through the humidifying fabric member mounting signal. Hereinafter, the configuration of the humidifying fabric member 200 will be described in detail with reference to FIG. 7. FIG. 7 is a cross-sectional view illustrating a humidifying fabric member.

Referring to FIG. 7, the humidifying fabric member 200 may include a humidifying fabric 210 to absorb water, a support frame 230 supporting the humidifying fabric 210, a water distributor 250 to evenly distribute water to the humidifying fabric 210, and a drain portion 270 to drain water flowing down along the humidifying fabric 210 without being absorbed by the humidifying fabric 210.

The humidifying fabric 210 may be made of a material such as fiber, paper, or the like, and may have a substantially rectangular shape. The humidifying fabric 210 receives water evenly from the water distributor 250 provided at the upper side of the humidifying fabric 210, holds the supplied water, and humidifies air passing through the humidifying fabric 210.

At this time, impurities such as dust contained in the air are filtered by the humidifying fabric 210 and pure air can pass through the humidifying fabric 210. Accordingly, the humidifying fabric 210 may perform a filtering function together with humidification.

The support frame 230 may include a first cover 233 and a second cover 235 which are respectively provided at the front and rear of the humidifying fabric 210 to support the humidifying fabric 210. The first cover 233 and the second cover 235 are connected to each other by a connecting portion 231. When the humidifying fabric 210 is to be replaced, the connection between the first cover 233 and the second cover 235 by the connecting portion 231 is released, and then the first cover 233 is opened. The used humidifying fabric 210 is taken out, a new humidifying fabric 210 is put on the second cover 235, and then the first cover 233 is closed. Then, the first cover 233 and the second cover 235 are connected to each other through the connecting portion 231. The water distributor 250 may be integrally formed on the upper portion of the support frame 230. The water distributor 250 uniformly distributes the water supplied from the water reservoir 100 to the humidifying fabric 210. Since the water distributor 250 has an open top, the inside of the water distributor 250 is at atmospheric pressure. Accordingly, the water collected in the water distributor 250 flows down to the upper portion of the humidifying fabric 210 by gravity.

A plurality of drainage holes 253 is formed in the bottom surface of the water distributor 250 at predetermined intervals along the width direction of the support frame 230. In this case, the number and the interval of the plurality of drainage holes 253 are determined so as to uniformly supply water to the entire humidifying fabric 210. The water discharged from the plurality of drainage holes 253 is supplied to the upper portion of the humidifying fabric 210 and then flows down along the humidifying fabric 210 and the support frame 230. Accordingly, water is uniformly absorbed over the entire area of the humidifying fabric 210, and vaporization is generated in the entire area of the humidifying fabric 210, so that the humidification efficiency may be increased.

The drain portion 270 may be integrally formed on the lower portion of the support frame 230. The drain portion 270 collects the water flowing down through the humidifying fabric 210 and discharges the water to the water collecting tank 400. The drain portion 270 is provided with a plurality of drainage holes 273 through which water that has passed through the humidifying fabric 210 flows in the width direction of the support frame 230.

Also, the bottom 277 of the drain portion 270 is formed to be inclined toward a drainage port 275. The water discharged through the drainage holes 273 is collected inside the drain portion 270 and discharged to the water collecting tank 400 through the drainage port 275 connected to the water collecting tank 400.

Figure 8A:
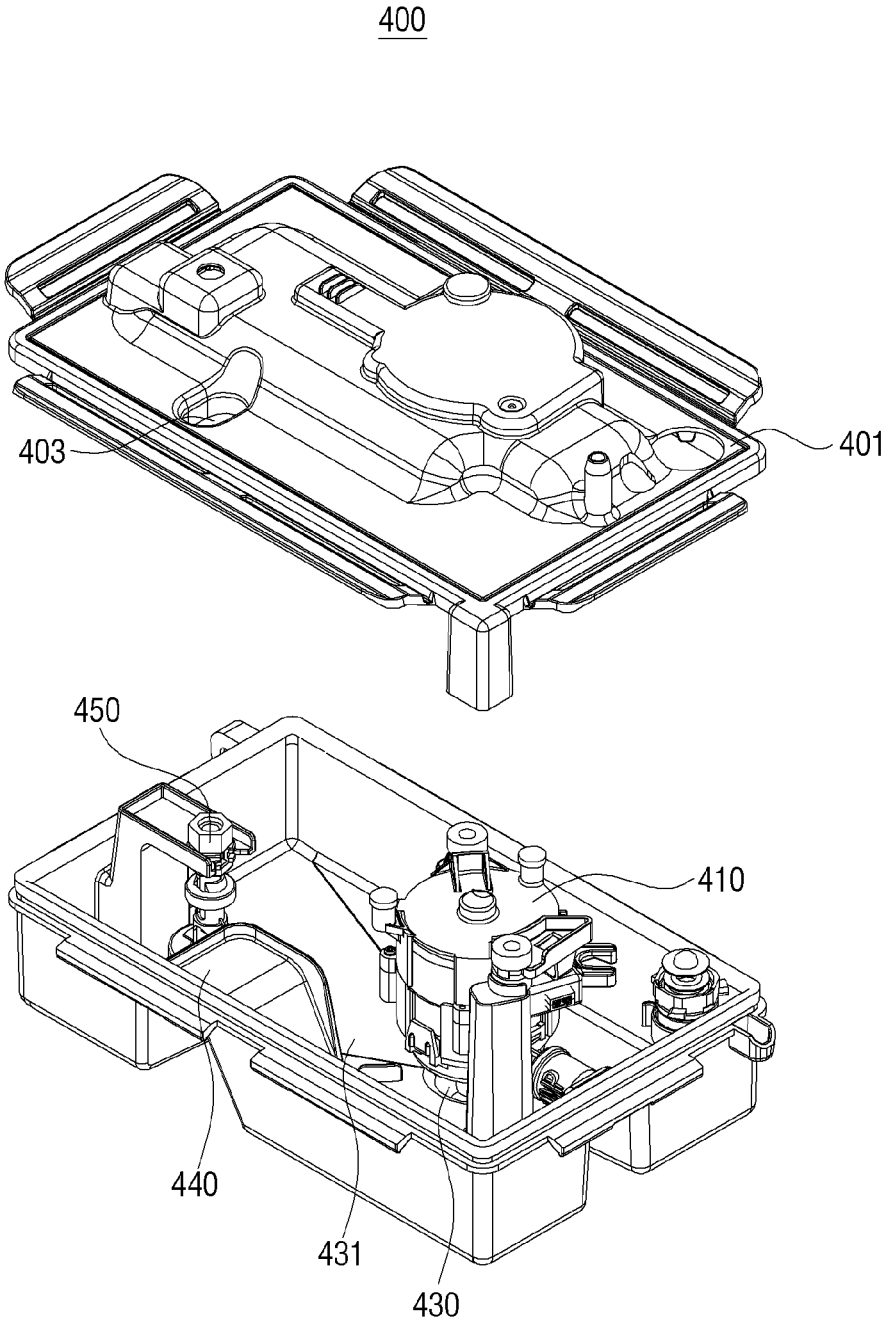
FIG. 8A is an exploded perspective view illustrating a water collecting tank.
Figure 8B:
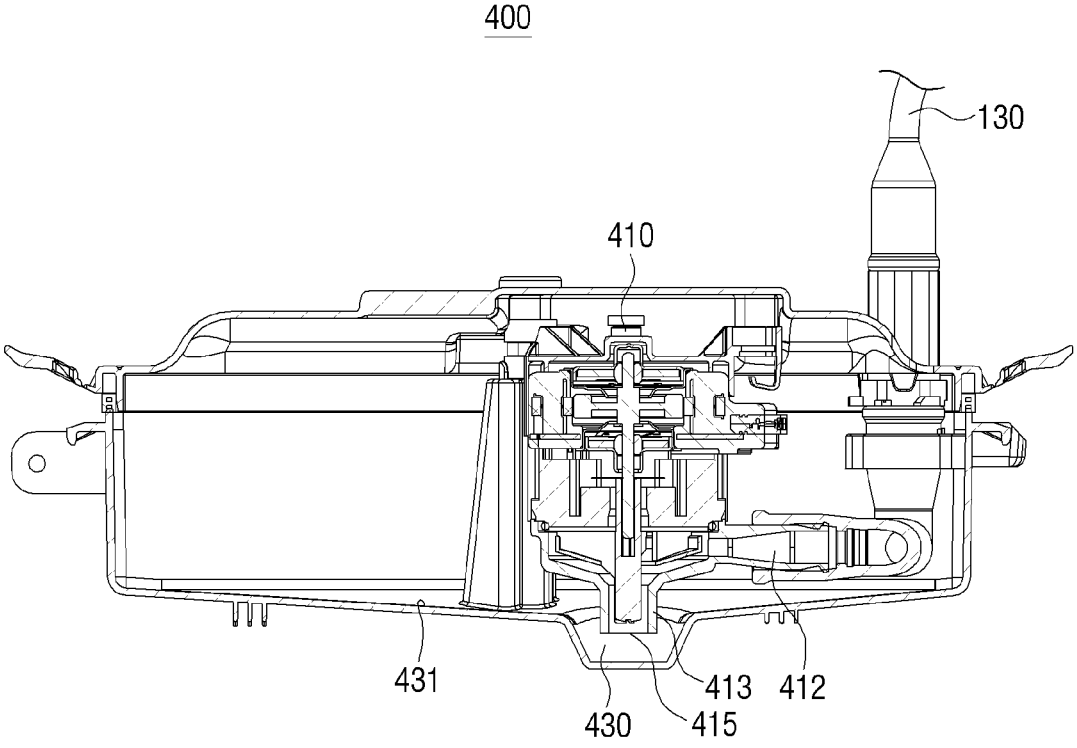
FIG. 8B is a cross-sectional view illustrating a water collecting tank.

FIG. 8A is an exploded perspective view illustrating a water collecting tank, and FIG. 8B is a cross-sectional view illustrating a water collecting tank.

The water collecting tank 400 is disposed below the humidifying fabric member 200, and collects the water that has passed through the humidifying fabric member 200. The water collected in the water collecting tank 400 is again transferred to the water reservoir 100 by pumping of the pump 410.

An upper cover 401 partitioning the other electric parts and the water collecting tank 400 is provided on the upper part of the water collecting tank 400. A connection hole 403 through which the drainage port 275 of the humidifying fabric member 200 passes is formed in the upper cover 401 of the water collecting tank 400. The connection hole 403 guides the water discharged through the drainage port 275 into the water collecting tank 400.

A drainage guide 440 protrudes from the bottom 431 of the water collecting tank 400 at a predetermined height so as to correspond to the connection hole 403. The top of the drainage guide 440 is positioned adjacent to the connection hole 403 so that the water falling from the connection hole 403 flows down to the bottom 431 of the water collecting tank 400 along the drainage guide 440. Accordingly, noise generated when the water is collected in the water collecting tank 400 may be reduced.

The pump 410 is disposed inside the water collecting tank 400. A discharge port 412 of the pump 410 is connected to the circulation pipe 130 and a suction port 413 of the pump 410 protrudes toward the bottom 431 of the water collecting tank 400. The water collected in the water collecting tank 400 is pumped to the water reservoir 100 through the pump 410, so that the water used for humidification can be circulated. Such a circulation system may prevent the water from being accumulated in any one place, thereby preventing the scale from being on the components of the air conditioner 1.

In order to minimize the amount of water remaining in the water collecting tank 400, the bottom 431 of the water collecting tank 400 may be formed to be inclined downward toward to one portion. A collecting groove 430 may be formed at the one portion. The collecting groove 430 is formed to be concave downward and is positioned lower than the bottom 431 of the water collecting tank 400. In this case, a suction hole 415 of the suction port 413 of the pump 410 is disposed inside the collecting groove 430. As the distance between the suction hole 415 and the collecting groove 430 is narrowed, the amount of water remaining in the water collecting tank 400 may be minimized. When the amount of water remaining in the water collecting tank 400 is minimized as described above, the water in the water collecting tank 400 may be prevented from being decayed and contaminated in advance.

Figure 9:
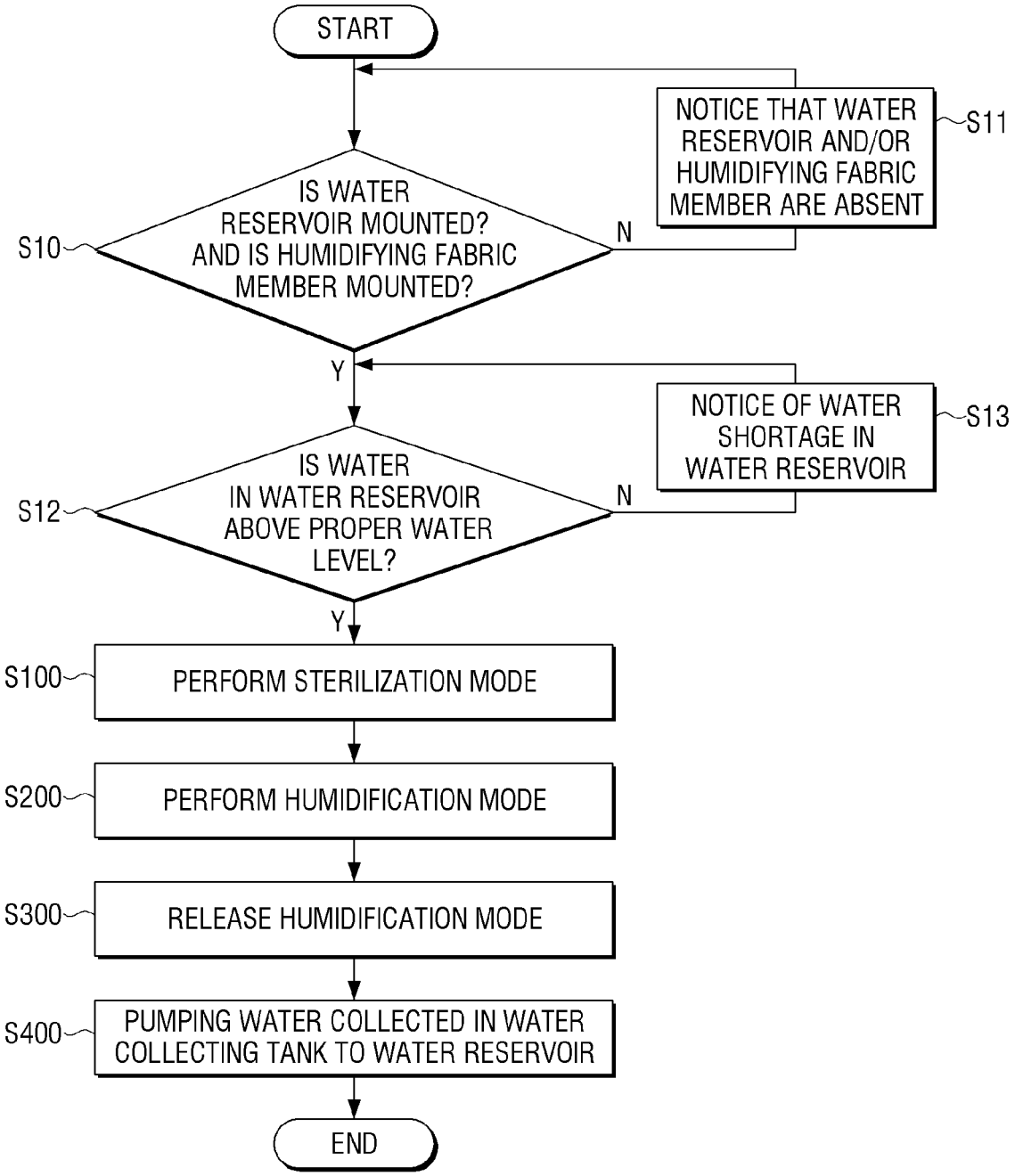
FIG. 9 is a flowchart illustrating a control process of an air conditioner according to an embodiment of the present disclosure.

FIG. 9 is a flowchart illustrating a control process of an air conditioner according to an embodiment of the present disclosure.

The input portion 17 may include a power on/off button, a mode selection button, and the like. Here, the mode may include a humidification mode and a sterilization mode. The input portion 17 receives commands such as a humidification mode on/off selection, a sterilization mode selection, or the like.

The controller 12 performs the humidification mode when the humidification mode is selected to be on, and cancels the humidification mode when the humidification mode is selected to be off. Also, the controller 12 performs the sterilization mode when the sterilization mode is selected, and releases the sterilization mode when a predetermined sterilization time passes after the sterilization mode is executed.

In addition, the controller 12 may control the sterilization mode to be automatically performed when the humidification mode is turned on. At this time, the controller 12 performs the sterilization mode for a predetermined period of time, and then performs the humidification mode after the predetermined period of time elapses.

Referring to FIG. 9, when the humidification mode and the sterilization mode are selected, the controller 12 identifies whether the water reservoir 100 and the humidifying fabric member 200 are mounted through the water reservoir mounting sensor 30 and the humidifying fabric member mounting sensor 40 (S10).

When any one of the water reservoir 100 and the humidifying fabric member 200 is not mounted, the controller may informs the user of at least one of the water reservoir 100 and the humidifying fabric member 200 is not mounted by displaying the non-mounted component on the display 18 and outputting sound through the speaker 19 (S11).

When both the water reservoir 100 and the humidifying fabric member 200 are mounted on the main body 10, the controller 12 checks whether or not the water in the water reservoir 100 is above the proper water level through the first water level sensor 170 (S12). When the water level of the water reservoir 100 is lower than the proper water level, the controller 12 informs the user of the lack of water in the water reservoir 100 through the display 18 and the speaker 19 (S13).

When the water in the water reservoir 100 is above the proper water level, the sterilization mode is performed (S100). In the sterilization mode, the controller 12 controls the sterilizing kit 120 to electrolyze water stored in the water reservoir 100, thereby performing a sterilization process.

After the sterilization mode is completed, the humidification mode is performed (S200).

After the humidification mode is completed, when a humidification mode release condition is satisfied, the humidification mode may be canceled (S300).

The condition in which the humidification mode is released may include cases in which the user inputs the release of the humidification mode, the water in the water reservoir 100 is below the proper water level, the water reservoir 100 is dismounted, and the humidifying fabric member 200 is dismounted.

When the humidification mode is released, the controller 12 turns off the solenoid valve 115 and the fan 300, and drives the pump 410 for a predetermined time to pump the water in the water collecting tank 400 to the water reservoir 100 (S400). The predetermined time may be set in consideration of the capacity of the water collecting tank 400. Thus, in the present embodiment, all or nearly all the water remaining in the water collecting tank 400 may be transferred to the water reservoir 100, so that the amount of water remaining in the water collecting tank 400 may be minimized. After a lapse of the predetermined time, the air conditioner 1 may be terminated. The predetermined time may be a time sufficient for the pump 410 to pump the entire water remaining in the water collecting tank 400 to the water reservoir 100 after the humidification mode is released.

Figure 10:
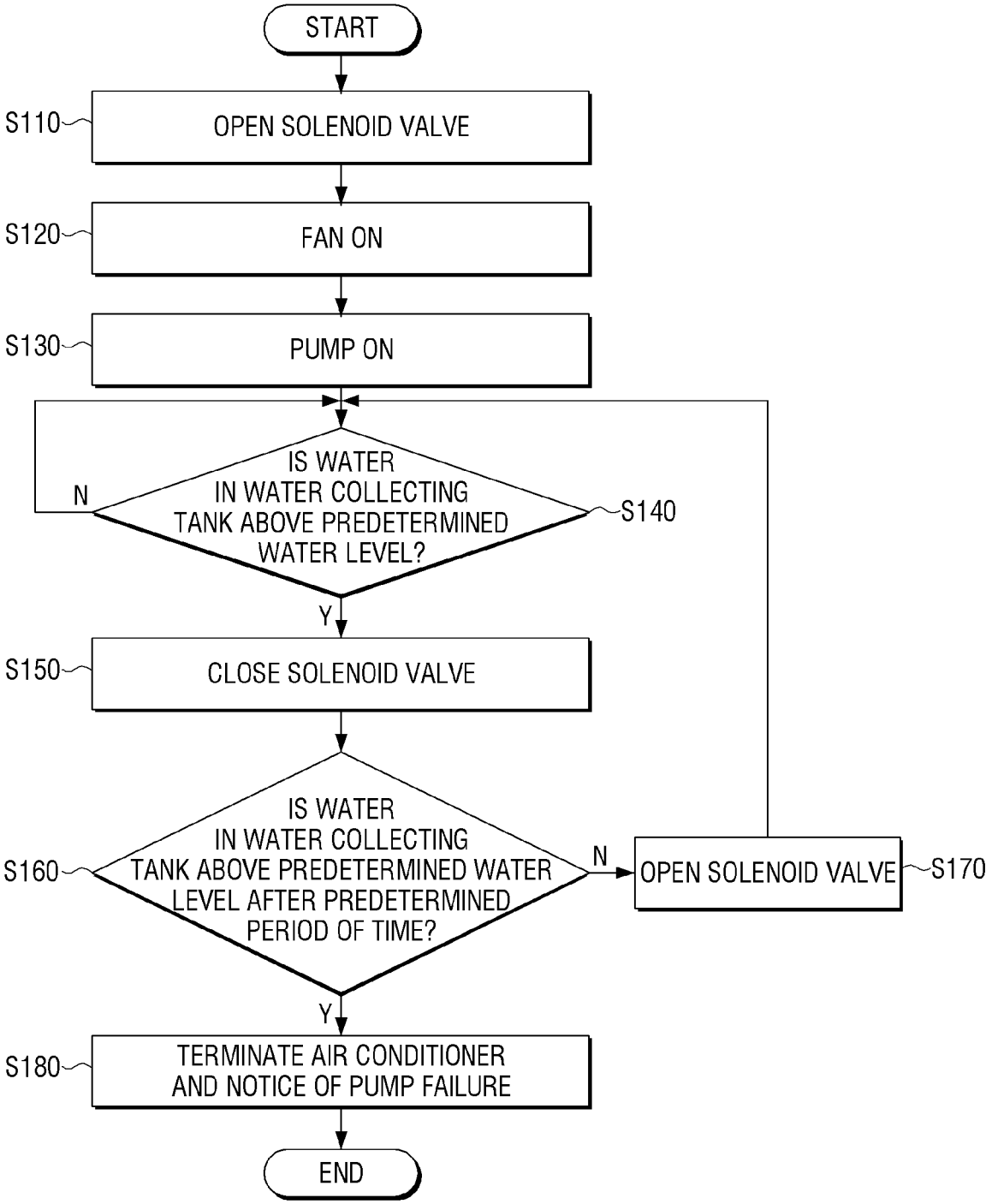
FIG. 10 is a flowchart illustrating a detailed configuration of the humidification mode performing operation in FIG. 9.

FIG. 10 is a flowchart illustrating a detailed configuration of the humidification mode performing operation as described above.

Referring to FIG. 10, the controller 12 controls the solenoid valve 115 to be opened in the humidification mode (S110) so that the flow path of the water collecting pipe 110 is opened. The controller 12 turns on the fan 300 (S120) so that external air is circulated, passes through the humidifying fabric member 200 containing moisture, and is discharged to the outside of the main body 10. Thus, water is supplied to the humidifying fabric member 200 through the water collecting pipe 110 in the humidification mode, and the air conditioner 1 discharges humid air into the room.

Also, in the humidification mode, the pump 410 is turned on (S130) so that the water collected in the water collecting tank 400 is pumped and transferred to the water reservoir 100.

At this time, the controller 12 identifies whether the water level of the water in the water collecting tank 400 is higher than the predetermined level through the second water level sensor 450 (S140). When the water level of the water collecting tank 400 is equal to or higher than the predetermined water level (full water level), the controller 12 controls the solenoid valve 115 to be closed for a predetermined period of time (S150). At this time, since the fan 300 and the pump 410 are in the on state, the fan 300 and the pump 410 are continuously operated.

After a predetermined time has elapsed, the controller 12 identifies whether the second water level sensor 450 senses the predetermined water level or more, that is, whether the water collecting tank 400 is maintained at the full water level (S160). When the second water level sensor 450 senses the predetermined water level or more after the predetermined time has elapsed, the controller 12 terminates the operation of the air conditioner 1, and notifies the user of the occurrence of an error through the display 18 and the speaker 19 (S180).

When the second water level sensor 450 does not sense the predetermined water level or more after the predetermined time has elapsed, the controller 12 opens the solenoid valve 115 (S170).

While the embodiments of the present disclosure have been described, additional variations and modifications of the embodiments may occur to those skilled in the art once they learn of the basic inventive concepts. Therefore, it is intended that the appended claims shall be construed to include both the above embodiments and all such variations and modifications that fall within the spirit and scope of the inventive concepts.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. An air conditioner comprising:

a main body;

a fan configured to cause air to flow through the main body;

a water reservoir detachably disposed on an upper portion of the main body;

a humidifying fabric member disposed inside the main body and configured to receive water from the water reservoir;

a water collecting tank configured to collect water that flows from the humidifying fabric member; and a pump configured to pump the water in the water collecting tank to the water reservoir through a suction hole, wherein a bottom of the water collecting tank is formed to be downwardly inclined toward one portion of the bottom and the suction hole of the pump is disposed adjacent to the one portion, wherein the water reservoir and the humidifying fabric member are connected by a water collecting pipe, wherein the water collecting tank and the water reservoir are connected by a circulation pipe, wherein the water collecting pipe is provided with a solenoid valve configured to control a supply of water to the humidifying fabric member, and wherein the circulation pipe is provided with a check valve configured to prevent water from flowing back from the water reservoir to the water collecting tank.

2. The air conditioner of claim 1, wherein:

a collecting groove that is lower than the bottom of the water collecting tank is formed at the one portion of the bottom of the water collecting tank, and the suction hole of the pump is disposed adjacent to the collecting groove.

3. The air conditioner of claim 1, wherein the humidifying fabric member comprises:

a support frame;

a humidifying fabric disposed in the support frame; and a water distributor provided at an upper end of the support frame and configured to distribute water supplied from the water reservoir to the humidifying fabric.

4. The air conditioner of claim 3, wherein the water distributor comprises an open top and a plurality of drainage holes formed at a bottom of the water distributor by intervals along a width direction of the support frame.

5. The air conditioner of claim 1, further comprising:

a sterilizing kit provided inside the water reservoir.

6. The air conditioner of claim 1, wherein:

the water reservoir comprises a plurality of opening and closing valves, and the plurality of opening and closing valves are opened when the water reservoir is mounted on the main body and are closed when the water reservoir is separated from the main body.

7. The air conditioner of claim 1, further comprising:

a first water level sensor disposed in a mounting groove of the main body in which the water reservoir is detachably disposed and configured to detect a water level of the water reservoir.

8. The air conditioner of claim 7, wherein the first water level sensor comprises a capacitive sensor.

9. The air conditioner of claim 1, further comprising:

a second water level sensor disposed inside the water collecting tank and configured to detect a water level of the water collecting tank.

10. An air conditioner comprising:

a main body;

a humidifying fabric disposed inside the main body;

a water collecting tank disposed downstream of the humidifying fabric;

a pump configured to circulate water from downstream of the humidifying fabric to upstream of the humidifying fabric; and a fan configured to circulate air from outside of the main body, and to cause the air to pass through the humidifying fabric moistened with water, wherein a suction hole of the pump corresponds to a lowest portion of an inclined bottom of the water collecting tank, wherein a water reservoir and a humidifying fabric member are connected by a water collecting pipe, wherein the water collecting tank and the water reservoir are connected by a circulation pipe, wherein the water collecting pipe is provided with a solenoid valve configured to control a supply of water to the humidifying fabric member, and wherein the circulation pipe is provided with a check valve configured to prevent water from flowing back from the water reservoir to the water collecting tank.

11. The air conditioner of claim 10, wherein:

the water collecting tank is provided with a collecting groove protruding downward at the lowest portion of the bottom of the water collecting tank, and the suction hole of the pump is disposed inside the collecting groove.

12. The air conditioner of claim 10, further comprising:

a water distributor disposed along a top end of the humidifying fabric and provided with a plurality of drainage holes spaced apart from each other.

13. The air conditioner of claim 10, further comprising:

the water reservoir disposed upstream of the humidifying fabric and configured to supply water to the humidifying fabric.

14. A control method of an air conditioner, the method comprising:

identifying whether a water reservoir and a humidifying fabric member are mounted on a main body of the air conditioner;

informing that at least one of the water reservoir and the humidifying fabric member is absent when the at least one of the water reservoir and the humidifying fabric member is not mounted;

sterilizing water in the water reservoir when both of the water reservoir and the humidifying fabric member are mounted;

performing a humidifying operation of supplying the sterilized water to the humidifying fabric member, circulating air to pass through the humidifying fabric member containing moisture, and discharging the air to an outside of the main body of the air conditioner;

terminating the humidifying operation when a predetermined time elapses; and pumping water collected in a water collecting tank through the humidifying fabric member to the water reservoir after the humidifying operation is terminated.

15. The control method of claim 14, wherein the performing the humidifying operation comprises:

supplying the water in the water reservoir to an upper portion of the humidifying fabric member;

uniformly discharging the water from the upper portion of the humidifying fabric member to a humidifying fabric of the humidifying fabric member; and pumping the water collected in the water collecting tank through the humidifying fabric to the water reservoir.

16. The control method of claim 14, wherein the performing the humidifying operation comprises stopping water supply from the water reservoir and pumping the water in the water collecting tank to the water reservoir when the water collecting tank is full water level.

17. The control method of claim 14, further comprising:

identifying whether the water in the water reservoir is above a proper water level before sterilizing water in the water reservoir, wherein when the water in the water reservoir is below the proper water level, water shortage is noticed, and when the water in the water reservoir is above the proper water level, the water in the water reservoir is sterilized.

* * * * *